US005803304A

United States Patent [19]

Berg

[11] Patent Number: 5,803,304

[45] Date of Patent: Sep. 8, 1998

[54] UNDERGROUND STORAGE TANK

[75] Inventor: Robin Berg, Hudson, Wis.

[73] Assignee: Xerxes Corporation, Minneapolis, Minn.

[21] Appl. No.: 517,620

[22] Filed: Aug. 22, 1995

[51] Int. Cl.[6] ..... B65D 90/06

[52] U.S. Cl. ..... 220/565; 220/654; 220/455; 220/457; 220/444

[58] Field of Search ..... 220/469, 444, 220/571, 651, 652, 653, 654, 565, 457, 454, 455, 456

[56] References Cited

U.S. PATENT DOCUMENTS

| | | | |
|---|---|---|---|
| 304,092 | 8/1884 | Francke | 220/469 |
| 584,165 | 6/1897 | Orwig | 220/654 |
| 2,154,044 | 4/1939 | Hartman | 220/654 |
| 2,658,253 | 11/1953 | Richardson | 220/651 |
| 4,004,706 | 1/1977 | Guldenfels et al. | 220/457 |
| 4,653,312 | 3/1987 | Sharp | 220/469 |
| 4,895,272 | 1/1990 | De Benedittis et al. | 220/565 |
| 4,948,007 | 8/1990 | Berg et al. | 220/444 |
| 5,220,823 | 6/1993 | Berg et al. | 220/469 |
| 5,320,247 | 6/1994 | Sharp | 220/654 |
| 5,421,479 | 6/1995 | Noorafshami | 220/571 |

*Primary Examiner*—Stephen J. Castellano
*Attorney, Agent, or Firm*—Oblon, Spivak, McClelland, Maier & Neustadt, P.C.

[57] ABSTRACT

An underground storage tank having a shape approximating a traditional bread loaf. A dome-shaped top extends vertically downward in integral common lateral sides, which terminate in an integral flat bottom.

10 Claims, 2 Drawing Sheets

UNDERGROUND STORAGE TANK

BACKGROUND OF THE INVENTION

1. Field of the Invention

This invention pertains to underground storage tanks intended for the storage of liquids such as gasoline, and underground installations for delivery, e.g., at service stations and the like. More specifically, an underground storage tank of reinforced resin materials is provided, the tank having a shape and design providing significant cost reductions, installation advantages, and handling advantages.

2. Background of the Prior Art

The provision of reinforced tanks or storage vessels for the containment of liquid materials, in particular, gasoline and assorted fuels, oils and other petroleum products, is well known. In general, a plurality of storage tanks are buried in an excavation which is ultimately backfilled with pea gravel and the like, and covered with a concrete apron which will become the operating surface of a gasoline service station, automobile lubricating installation, etc.

Conventionally, such tanks are cylindrical in shape with dome or egg-shaped end caps at either end of the cylinder. Access to the tank is provided via fill pipe and pump means for introduction and/or removal of liquid from the storage tank.

Historically, these underground storage tanks have been constructed of steel and steel alloy materials. However, as related in U.S. Pat. No. 3,700,512, and increasingly in the media, the use of steel and related compounds presents the possibility of corrosion of the steel particularly if the underground installation site should become filled with water or brine. Thus increasingly, alternative corrosion-resistant materials, such as cured resin reinforced with filamentary material, generally fiberglass, have been adopted in substitution of steel in the construction of underground storage tanks. Although steel, per se, is generally a stiffer material than reinforced resinous materials, the underground storage tanks comprised of these corrosion-resistant materials are designed, generally by the additional circumferential ribs, to withstand the forces imposed on the underground tanks. In general, the "worst case scenario" is of a tank in a relatively deep pit which is filled with water or other aqueous systems, such as brine.

In a wide variety of geographical locations, notably California, further attention has been paid to the possible environmental contamination problem posed by leakage through these corrosion-resistant tanks. Puncture or failure of the tank, either catastrophic or of limited dimension, may result in substantial pollution without detection until a large amount of environmental damage may be done. To better guard against such problems, a wide variety of "secondary containment" devices have been advanced. Thus, U.S. Pat. No. 4,561,292 describes what is essentially a "double-wall" storage tank comprising an inner tank and an outer tank of similar shape surrounding that inner tank, with an annulus spaced therebetween. The outer tank is the secondary containment means. Should a leak or failure develop in the inner tank, the presence of the outer tank will prevent release of the stored materials to the environment, until repairs can be effected. An alarm means, either dry or wet, is provided in the annular space so that a leak occurring in the inner tank, given a dry system, or either tank, in the event a wet system is installed, is detected early and repairs affected before environmental damage can occur. In one variation of this double-walled system, a gas pervious material is provided in the annular space. Such a system is addressed in U.S. Pat. No. 4,739,659.

All of the described systems employ a tank which is circular in cross section, cylindrically-shaped overall. The use of such a shape, while convenient for the purposes of molding and construction, provides a tank that has more of a tendency to roll during transport and installation than the tank of the present invention. To accommodate a plurality of cylindrical tanks in a given installation such as a service station offering three or more types of gasoline, a relatively large excavation must be made to accommodate even moderate sized tanks compared with tanks of the present invention of the same capacity.

Accordingly, it remains an objective of the art to provide a corrosion-resistant tank for underground installation that is resistant to the forces encountered when installed, can be provided with a secondary containment system where necessary, has a reduced tendency to roll, occupies less space for a given volume, and is more easily transportable.

SUMMARY OF THE INVENTION

The above objectives, and other objectives that will become clear from the following specifications are achieved by the provision of a storage tank comprised of corrosion-resistant materials such as reinforced resin materials of a non-cylindrical design. The tank approximates the shape of a traditional loaf of bread in transverse cross section, having a dome or semicylindrical-shaped top, which extends downwardly in integrally formed sidewalls. The sidewalls terminate in a substantially flat bottom, also integrally formed. Reinforcement for the structure is provided by internal reinforcing means such as an internal rib adapted to the shape of the tank. This rib can be comprised of a circular tube or bar made of steel or steel alloy materials attached to a U-shaped steel alloy frame. The upper portion of the tube or bar is in contact with the dome-shaped top, while the lower U-frame supports the lateral sidewalls and bottom. Alternatively, the internal ribs may be molded into the tank, circumferentially.

The tank may be provided with a secondary containment shell, of similar shape but exterior to the inner wall. The two shells may be separated by an annular load-transmitting material which may be adhered to both tanks thereby providing resistance to shear forces. The presence of the load-transmitting material allows the two shells to operate as one in terms of strength, reducing the amount of material necessary in the shell to meet performance requirements. Additionally, adherence of the annular load-transmitting material to the outer shell will prevent its bowing outward under pressurization should such become necessary.

The tank terminates in end caps which are somewhat "flatter" than the traditional hemispherical end cap design associated with cylindrical tanks and describe an ellipse in cross-section. Because of the flat bottom provided, the tanks resist rolling, and may be fixed in place by tie downs attached to either end of the tank.

The tanks may be installed in contact with one another in the excavation. As the vertical sidewalls abut each other, there is no need to introduce backfill between each tank. As a result, the size of the excavation itself, and the amount of backfill introduced are significantly reduced, achieving an extremely significant cost savings.

The inventive tanks may be mounted sideways on carriers commonly employed in the industry such as flat-beds and the like. Thus, two or three tanks may be shipped simultaneously where only a single cylindrical tank, of volume equal to one of the tanks so shaped can be accommodated.

DETAILED DESCRIPTION OF THE INVENTION

Figure 1:
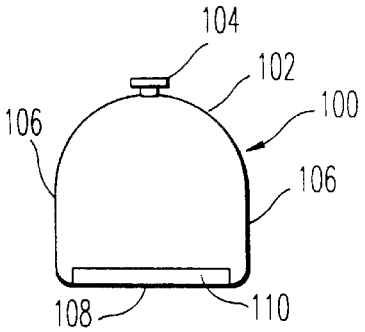
FIG. 1 is an end view of the underground storage tank of the invention.

The underground storage tank addressed herein is generally indicated at 100, FIG. 1.

The tank is a single, integral shell, and accordingly, though reference is made to identifiable proportions of the tank, it should be understood that all parts are integral and continuous one to the next. The top of the tank 102 is dome-like in shape, circular in cross section, corresponding to an arc of about 140°–180°. In the top may be provided fittings 104, for communication with fill means, pump means and similar attachments for delivery and removal of liquid, and operation of the tank. The fittings and associated means do not constitute an aspect of the invention, per se, and are conventional in the art.

Figure 2:
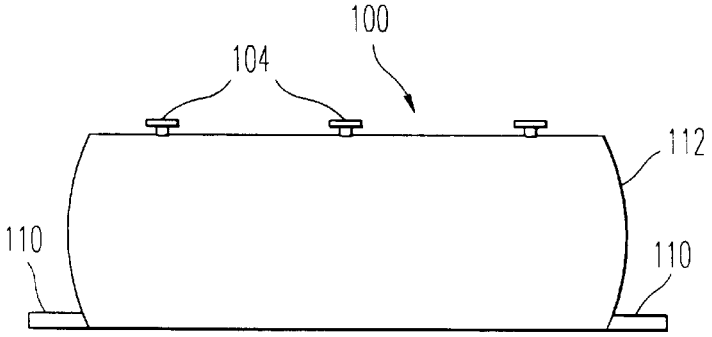
FIG. 2 is a longitudinal side view of the storage tank of this invention, pictured with tie-downs attached as they would be in installation.

Dome-shaped top 102 extends vertically downward in lateral sidewalls 106 which continue to a relatively flat bottom 108. The intersection of bottom 108 and sidewalls 106 are only slightly rounded. The bottom may be flat or slightly concave or slightly convex in transverse cross section. As illustrated, in FIG. 1, the end of tank 100 is provided with a tie-down 110 which serves to anchor the tank to the floor of the installation. An identical tie-down is provided at the opposite end. As best illustrated in FIG. 2, a tank 100 terminates in ends 112 which are semi-elliptical in shape.

Figure 3:
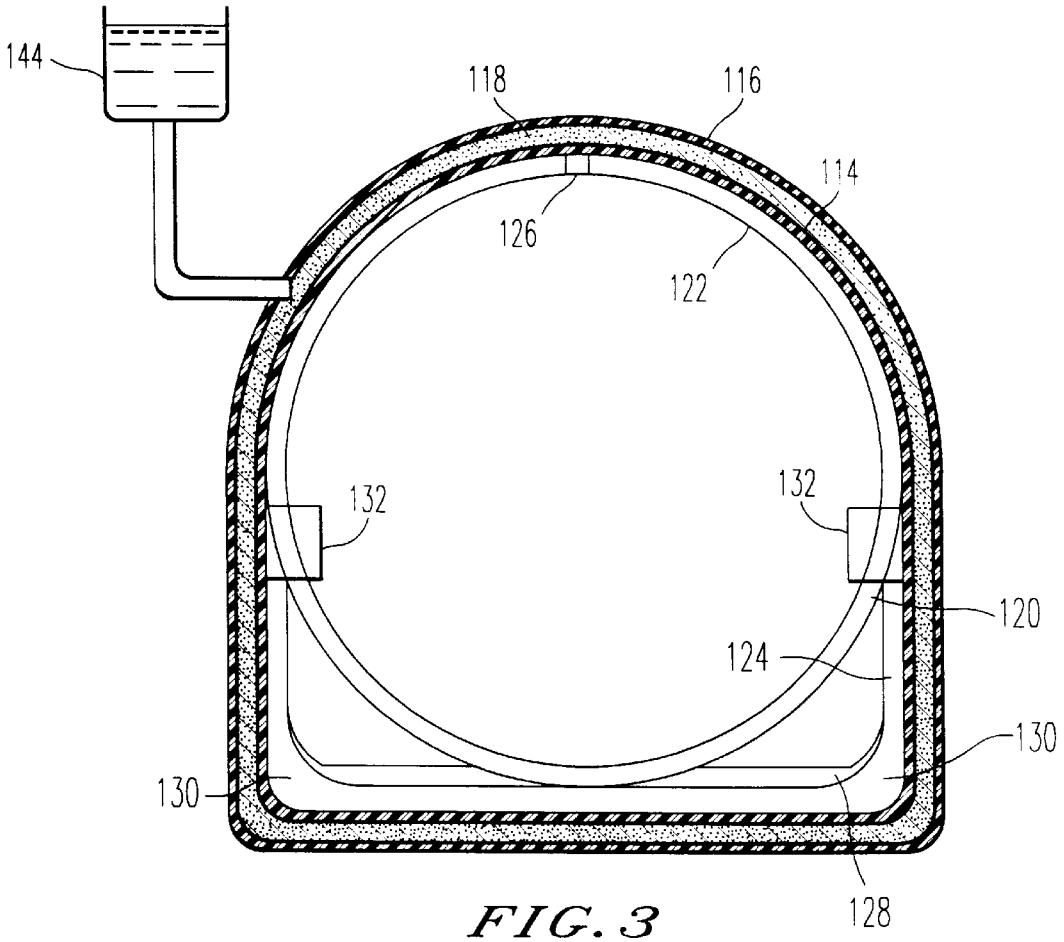
FIG. 3 is a transverse cross section through the tank of the invention, illustrating an internal rib and a secondary containment system.

The inventive storage tank is comprised of resinous materials reinforced with shaped glass fiber, etc. These materials are conventional in the art, per se, and methods of applying same are well known. To provide sufficient stiffness to withstand the pressures applied in installation, it is necessary to provide the shell with reinforcing means. In conventional cylindrical systems, such reinforcing means classically take the shape of exterior ribs affixed to the surface of the tank, if made through a male molding procedure, or integral with the tank, if made through a female molding procedure. As illustrated in FIG. 3, the reinforcement means is provided interior to the shell. In FIG. 3, the tank is illustrated as a "double-walled" system, providing secondary containment for any liquid stored in the tank. Thus, inner shell 114 and outer shell 116 are of similar design, and separated by annular material 118. In the preferred embodiment illustrated in FIG. 3, stiffening reinforcement is provided by internal rib 120. One example of such an internal rib is found in U.S. Pat. No. 4,948,007, the disclosure of which is incorporated herein by reference. Although, as discussed below, alternate reinforcement means can be provided, it is generally preferable to provide the rib interior to the shell, or the exterior shell, if a double-walled system is envisioned. However, ribs may be provided on the exterior of the outer shell, if desired.

Figure 4:
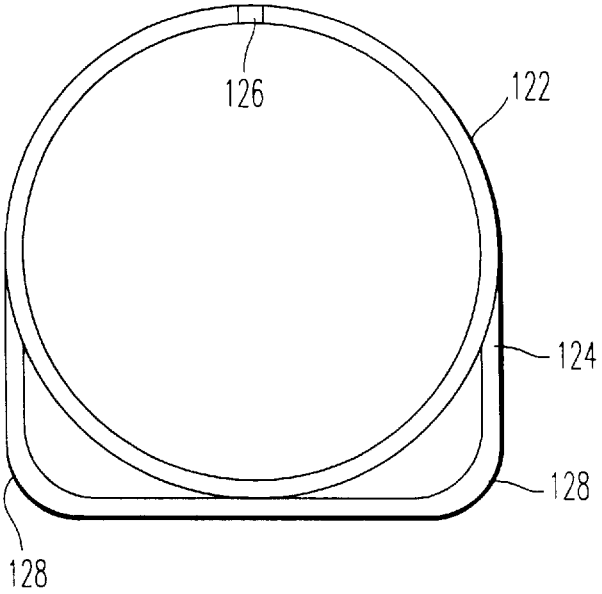
FIG. 4 is a detailed illustration of the interior rib of FIG. 3.

As illustrated in FIG. 4, internal reinforcement means 120 is comprised of a steel or steel alloy circular tube or bar, attached to a U-shaped steel alloy frame. The frame attaches to the tube or bar 122 at a point corresponding to the transition between dome-shaped top 102 and lateral sidewall 106. Alternative materials such as oriented fiber/resin matrix composites may be used. Frame 124 may be attached to the tube or bar 122 by welding or other conventional means. At the top the circular tube or bar 122 is provided a port, or pass through 126. This port 126 is essential to allow vapor trapped in the tank to pass along the top of the tank to a vent pipe and so escape to the outside, or some controlled recovery device. In installation, the tank will be installed such that the gas may pass to the vent, which is placed at the upper most end. In the absence of the vents provided, gas bubbles would form at the top of the tank and lodge there against the rib, preventing complete filling and perhaps threatening the integrity of the tank.

The corners 128 of the U-shaped frame of the rib have a radius (smaller) than the corresponding corners of the interior shell 114. This creates a space 130 between the corners of the rib and the corners of the shell which is essential to provide for the passage of liquid such as the stored product to the end of the tank opposed to the gas vent so that 100% of the liquid may be drained when it becomes necessary to change the nature of the product in the tank or access the interior of the tank for repairs and the like. In the absence of an appropriate passage 130 as described, pools of liquid may be formed behind the rib.

The tank may be prepared through either male or female molding techniques. Male molding techniques such as those described in U.S. Pat. No. 4,561,292, call for application of layers of resin and filamentary material to a mandrel which is either collapsible or provided with a separating agent. A male molding process is desirable as it allows placement of the rib on the mandrel, initially, in notches provided in the mandrel and lay-up of the resin and reinforcing materials around the rib in a single step without fine tolerance controls. Alternatively, the tank may be prepared through a female molding process such as that set forth in U.S. Pat. No. 4,363,687. When using a female mold and the interior rib of FIG. 4, it is necessary to control tolerances to provide sufficient space to "walk" the rib into the interior of the molded tank. Once in position, a final layer of resin with reinforcement material may be sprayed over the interior to fix the rib in position. Alternatively, rib 120 may be prepared in sections and assembled in the prepared tank.

To more firmly attach the rib to lateral sidewalls 106 and prevent those walls from "bowing out" under pressure particularly in a double-walled tank, it may be necessary to clamp the rib to the sidewalls with clamps 132. Again, these are conventional in nature and may be added after formation of the rib/tank shell assembly. The clamps pass around rib 120 and are adhered to wall 106 by adhesive, mechanical fasteners, etc. Under most applications, the ribs may be merely adhered to the wall with a suitable adhesive or "glassing in."

Figure 5:
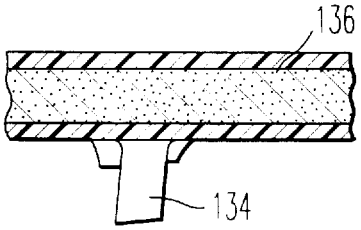
FIG. 5 is a limited longitudinal cross section of the interior of the tank illustrating an alternative rib reinforcement design.

As noted, rib 120, as illustrated in FIG. 4, may be prepared from steel. A preferred embodiment, because of its ease of manufacture, is a hollow steel tube generally square in cross-section. Thus, to achieve port 126, a section of the tube need only be cut, and rotated 90° out of the point of the rube rewelded. However, alternative forms such as I-beams, T-beams, J-beams and the like, may be similarly employed. In an alternative preferred form, the ribs are prepared from fiberglass reinforced plastic or similar materials. Where these alternative forms are used, or solid steel or similar materials are employed, it is necessary to prepare the materials with port 126 provided, either in the formation of the materials or subsequently, by drilling, etc.

Where desired, alternative reinforcement can be provided as illustrated in FIG. 5. FIG. 5 is a portion of a longitudinal cross section of a double-walled tank of the type illustrated in FIG. 3 but with a molded-in reinforced resin rib 134 in place of interior steel rib 120. Rib 134 may be formed integral with inner shell 114 in either a male or female molding process. Conventionally, a rib may be cast or formed outside the tank to provide a shape to provide reinforcement to the tanks. Rib 134 is then inserted in the interior of the tank and adhered to the interior of the tank shell 114 by "glassing in." In preferred embodiments, annular material 136 is a load transmitting material allowing walls 116 and 114 to act in unison, considerably strengthening the portion of the tank between ribs 134 which extend circumferentially about the tank itself and reducing the amount of material necessary to prepare the walls. Thus, annular material 136 may be plastic webbing, a honeycomb laminate, porous mineral wool, etc.

As noted above, alarm systems for tanks provided with secondary containment means are notorious in the art and do not constitute an aspect of the invention, per se. Where a wet alarm system is employed, the annulus is filled with a liquid material. When a leak in either inner shell 114 or outer shell 116 occurs, there is a loss of annular fluid which is detected by a change in the level of a fill pipe 144 extending to the annular space and above the level of the tank itself. Where a dry alarm system is employed, generally an electrical device with insulating material provided between current carriers is placed in the bottom of the tank. The insulating material is sensitive to the liquid stored in the tank such that, should said liquid leak out of the inner tank, it contacts the insulating material and changes the insulating characteristics of that material. This results in a short circuit or change in resistance which is detected.

Figure 6:
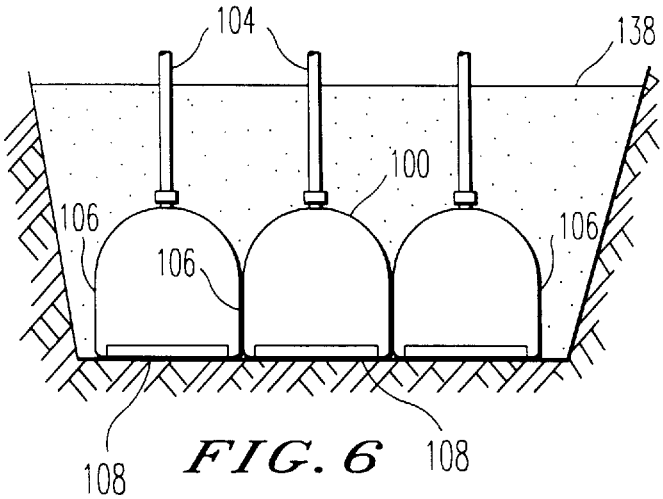
FIG. 6 is a schematic end view of three of the inventive tanks, as installed.

As illustrated in FIG. 6, the inventive tanks are installed in an excavation below surface 138. Because sidewalls 106 extend perpendicularly from top 102, the tanks can be installed in contact with one another. Backfill is then introduced to bury the tanks and fill up the excavation with access means 104 such as fill pipes and delivery systems extended above the surface. This type of installation results in a sharp reduction in the amount of backfill required as compared with similar installations employing cylindrical tanks. As installation costs represent a significant portion of the overall cost of the installed tank, the new design addressed herein provides for significant economies that simply cannot be achieved using cylindrical-shaped tanks.

Similarly, flat bottom 108 facilitates handing and shipment. The tanks which for an equal volume are significantly shorter than a cylindrical tank may be mounted sideways on a conventional flat-bottom trailer. This will permit transport of two tanks at once.

Obvious, numerous modifications and variations of the present invention are possible in light of the above teachings. Use of various resins and reinforcing materials as well as alternate materials and shaped for the internal rib of the invention will not depart from the scope of the invention. It is therefore to be understood that within the scope of the appended claims, the invention may be practiced otherwise than as specifically described herein.

What is claimed is:

1. A storage tank for the containment of liquids underground comprised of reinforced resinous materials, said storage tank having an inner wall in contact with said liquid and being of a shape comprising a semi-cylindrical shaped top, said top extending integrally downward as vertical sidewalls, said vertical sidewalls terminating in an integrally formed, substantially flat bottom, said tank being reinforced with circumferential reinforcing rib means interior to the external surface of said tank.

2. The storage tank of claim 1, wherein said internal circumferential rib means is comprised of a steel rib adjacent to the interior surface of said tank.

3. The storage tank of claim 1, wherein said circumferential rib means comprises a circumferential rib formed with the wall of said storage tank and comprised of reinforced resinous material.

4. The storage tank of claim 2, wherein said steel rib means comprises a circular steel member, the radius of curvature being substantially identical to the radius of said semi-cylindrical shaped top, said rib further comprising a U-shaped frame attached to said circular steel member at a point corresponding to the intersection between said dome-shaped top and said vertical sidewalls.

5. The storage tank of claim 1, further comprising a secondary containment means, said secondary containment means comprising an exterior wall surrounding said inner wall and being of a shape similar thereto, said inner wall and exterior wall defining there between an annular space.

6. The storage tank of claim 5, wherein said annular space is provided with an alarm means responsive to the formation of a leak in either said inner wall or said exterior wall.

7. The storage tank of claim 5, wherein said annular space is occupied by a material in which liquid freely flows, said material transmitting applied loads to either said exterior wall or said inner wall in a direction normal to the surface against which said load is applied.

8. The storage tank of claim 7, wherein said exterior wall is adhered to said material occupying said annular space, providing shear resistance thereto.

9. The storage tank of claim 2, wherein said steel rib is provided with a port, for the passage of gas therethrough, at the uppermost portion thereof.

10. The storage tank of claim 1, wherein said storage tank terminates, longitudinally, in end caps which are semi-elliptical in cross section.

* * * * *